US010400698B2

(12) United States Patent
Li

(10) Patent No.: US 10,400,698 B2
(45) Date of Patent: Sep. 3, 2019

(54) INJECTION VALVE AND OPERATION OF AN INJECTION VALVE

(71) Applicant: Continental Automotive GmbH, Hannover (DE)

(72) Inventor: Hui Li, Regensnburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 215 days.

(21) Appl. No.: 15/028,429

(22) PCT Filed: Oct. 10, 2014

(86) PCT No.: PCT/EP2014/071809
§ 371 (c)(1),
(2) Date: Apr. 10, 2016

(87) PCT Pub. No.: WO2015/052332
PCT Pub. Date: Apr. 16, 2015

(65) Prior Publication Data

US 2016/0252034 A1 Sep. 1, 2016

(30) Foreign Application Priority Data

Oct. 11, 2013 (DE) ..... 10 2013 220 528

(51) Int. Cl.
*F02M 63/00* (2006.01)
*F02D 41/20* (2006.01)
(Continued)

(52) U.S. Cl.
CPC ..... *F02D 41/2096* (2013.01); *F02M 47/027* (2013.01); *F02M 63/0014* (2013.01);
(Continued)

(58) Field of Classification Search
CPC ..... F02M 2200/70; F02M 2200/701; F02M 2200/703; F02M 47/027; F02M 63/0014;
(Continued)

(56) References Cited

U.S. PATENT DOCUMENTS 1,909,014 A * 5/1933 Schaeren ..... F02M 61/10 239/89
5,860,597 A 1/1999 Tarr ..... 239/124
(Continued)

FOREIGN PATENT DOCUMENTS

CN 102812232 A 12/2012 ..... F02M 47/02
DE 10146756 C1 4/2003 ..... F02M 47/02
(Continued)

OTHER PUBLICATIONS

German Office Action, Application No. 102013220528.7, 5 pages, dated May 20, 2014.
(Continued)

*Primary Examiner* — Jason J Boeckmann
(74) *Attorney, Agent, or Firm* — Slayden Grubert Beard PLLC

(57) ABSTRACT

The present disclosure relates to an injection valve comprising an injector body, a needle body, a control space, a control valve, and a piezoelectric actuator. The injector body has a recess and a fluid inflow and a fluid outflow. The needle body is arranged axially movably in the recess of the injector body and suppresses a fluid flow through an injection opening of the injector body in a closed position of the needle body and otherwise releases it. The control space is disposed in the recess between the fluid inflow and the fluid outflow. The control valve may be arranged in the control space to suppress a fluid flow between the control space and the fluid outflow in a closed position of the valve body and to otherwise release it. The piezoelectric actuator may be
(Continued)

coupled mechanically to the control valve via a first transmitter for opening the control valve.

3 Claims, 5 Drawing Sheets

(51) Int. Cl.
*F02M 47/02* (2006.01)
*F02M 65/00* (2006.01)

(52) U.S. Cl.
CPC ..... *F02M 63/0026* (2013.01); *F02M 65/005* (2013.01); *F02M 2200/70* (2013.01); *F02M 2200/701* (2013.01); *F02M 2200/703* (2013.01)

(58) Field of Classification Search
CPC ..... F02M 63/0026; F02M 65/005; F02M 63/007; F02M 63/0064; F02M 47/022; F02M 47/025; F02M 2200/702; F02D 41/2096
USPC ..... 239/91, 584
See application file for complete search history.

(56) References Cited

U.S. PATENT DOCUMENTS

| | | | | |
|---|---|---|---|---|
| 6,253,736 | B1 | 7/2001 | Crofts et al. | 123/498 |
| 6,776,390 | B1 * | 8/2004 | Boecking | F02M 47/027 251/129.06 |
| 9,316,190 | B2 | 4/2016 | Fedrow et al. | |
| 2005/0199746 | A1 * | 9/2005 | Bartunek | F02M 51/0603 239/102.2 |
| 2013/0153675 | A1 * | 6/2013 | Kronberger | F02M 61/168 239/1 |
| 2014/0326218 | A1 | 11/2014 | Ruße et al. | 123/478 |

FOREIGN PATENT DOCUMENTS

| | | | | |
|---|---|---|---|---|
| DE | 102005025141 | B3 | 9/2006 | F02M 47/02 |
| DE | 102005044389 | B3 | 2/2007 | F02M 47/02 |
| DE | 102007006941 | A1 | 8/2008 | F02M 47/02 |
| DE | 102008042136 | A1 | 3/2010 | F02M 47/02 |
| DE | 102008043085 | A1 | 4/2010 | F02M 51/06 |
| DE | 102011075750 | A1 | 11/2012 | F02D 41/20 |
| EP | 2320061 | A1 | 5/2011 | F02M 45/12 |
| WO | 01/63121 | A1 | 8/2001 | F02D 41/20 |
| WO | 2015/052332 | A1 | 4/2015 | F02D 41/20 |

OTHER PUBLICATIONS

International Search Report and Written Opinion, Application No. PCT/EP2014/071809, 23 pages, dated Feb. 4, 2015.

Chinese Office Action, Application No. 201480055900.4, 12 pages, dated Jul. 24, 2017.

* cited by examiner

INJECTION VALVE AND OPERATION OF AN INJECTION VALVE

CROSS-REFERENCE TO RELATED APPLICATIONS

This application is a U.S. National Stage Application of International Application No. PCT/EP2014/071809 filed Oct. 10, 2014, which designates the United States of America, and claims priority to DE Application No. 10 2013 220 528.7 filed Oct. 11, 2013, the contents of which are hereby incorporated by reference in their entirety.

TECHNICAL FIELD

The present disclosure generally relates to injection valves and specifically to a method for the operation of an injection valve.

BACKGROUND

On account of ever more stringent legal requirements with regard to permissible pollutant emissions of internal combustion engines, injection accuracy of injection valves of the internal combustion engine is of central importance. The present disclosure provides an injection valve and a method for the operation of the injection valve which contribute to a high injection accuracy of the injection valve being achieved.

SUMMARY

In some embodiments, an injection valve has an injection body with a recess with a fluid inflow and a fluid outflow. The injection valve has a needle body which is arranged axially movably in the recess of the injector body and which suppresses a fluid flow through an injection opening of the injector body in a closed position of the needle body and otherwise releases it. The injection valve has a control space which is arranged in the recess and which is arranged hydraulically between the fluid inflow and the fluid outflow. The injection valve has a control valve with a valve body which is arranged in the control space and which is configured to suppress a fluid flow between the control space and the fluid outflow in a closed position of the valve body and to otherwise release it. The injection valve has a piezoelectric actuator which is coupled mechanically to the control valve via a first transmitter for opening the control valve, it being possible for the piezoelectric actuator to additionally be coupled mechanically to the needle body for closing the injection valve.

Mechanical bounce can be detected by means of the piezoelectric actuator as a result of the mechanical coupling of the needle body to the piezoelectric actuator. The times at which the mechanical bounce occurs can be utilized for a regulation of the injection valve, in order to achieve a high injection accuracy. Times of this type are, for example, the reaching of the closed position of the needle body, and the reaching of a predefined opening position of the needle body.

In some embodiments, the piezoelectric actuator can be coupled mechanically to the needle body via a second transmitter which is connected to the needle body. As a result, a mechanical bounce of the needle body can be transmitted particularly satisfactorily to the piezoelectric actuator.

In some embodiments, the piezoelectric actuator is coupled mechanically to the needle body after a predefined idle stroke between the second transmitter and the piezoelectric actuator has been overcome. This ensures that the piezoelectric actuator is not always coupled mechanically to the needle body, with the result that, for example when the predefined open position of the needle body is reached, a mechanical bounce is produced.

In some embodiments, the piezoelectric actuator is coupled mechanically to the needle body when the closed position of the needle body is reached and when a predefined open position of the needle body is reached. As a result, a mechanical bounce can be detected when the closed position is reached, and when the predefined open position is reached.

In some embodiments, a method for the operation of the injection valve may include discharging the piezoelectric actuator electrically for opening the control valve by means of the first transmitter and for opening the injection valve as a result. A time of a first mechanical bounce is detected by means of the piezoelectric actuator, which bounce is transmitted to the piezoelectric actuator by way of the mechanical coupling of the piezoelectric actuator to the needle body when a predefined open position of the needle body is reached. In a manner which is dependent on the detected time of the first mechanical bounce, the piezoelectric actuator is charged electrically for closing the injection valve by means of the mechanical coupling of the piezoelectric actuator to the needle body, for example in a following work cycle of the injection valve or in the same work cycle of the injection valve, in which the first mechanical bounce was detected.

In some embodiments, a time of a further mechanical bounce is detected by means of the piezoelectric actuator, which further mechanical bounce is transmitted to the piezoelectric actuator when the closed position of the needle body is reached by way of the mechanical coupling of the piezoelectric actuator to the needle body.

By way of the mechanical coupling of the piezoelectric actuator to the needle body, the time of the first mechanical bounce and/or the time of the further mechanical bounce can be detected. Said two times or one of the two times can be utilized for the regulation of the injection valve, in order thus to achieve a high injection accuracy.

BRIEF DESCRIPTION OF THE DRAWINGS

The invention is explained in greater detail in the following text using the diagrammatic drawings, in which.

Figure 1:
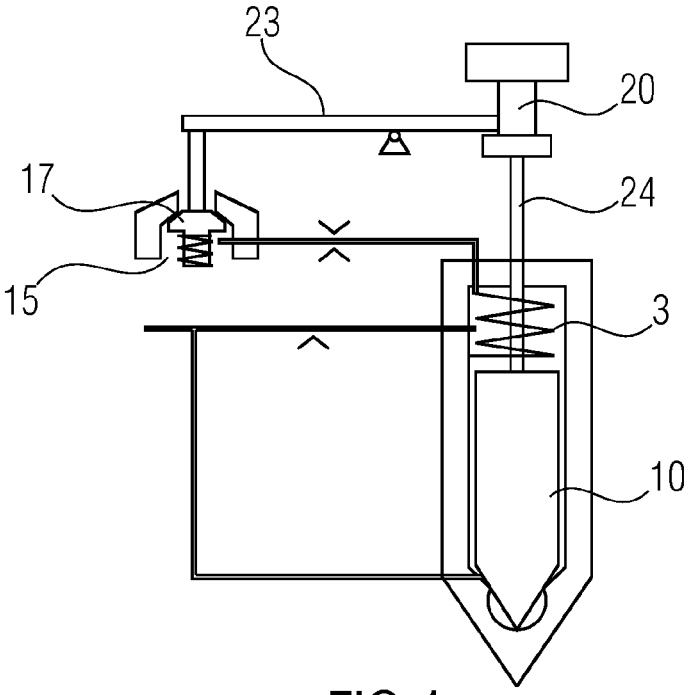
FIG. 1 to FIG. 6 show an example injection valve at various operating times, according to teachings of the present disclosure
Figure 2:
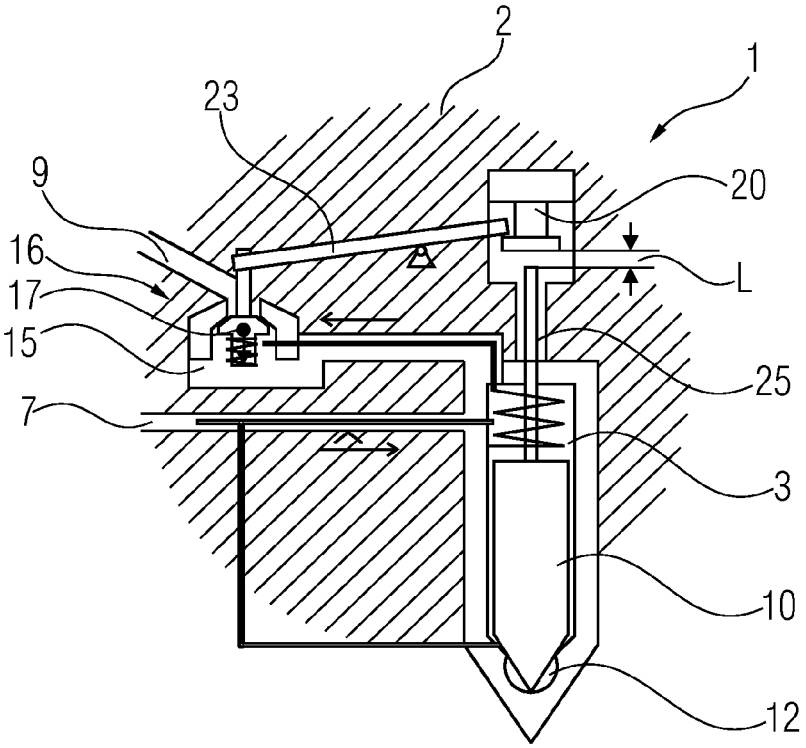

Elements of identical construction or function are identified by the same designations in all figures.

DETAILED DESCRIPTION

FIGS. 1 to 6 show an example injection valve 1 at various operating times. The injection valve 1 will be explained in greater detail using FIG. 2.

The injection valve 1 has an injector body 2. The injector body 2 has a recess 3, and a fluid inflow 7 and a fluid outflow 9. The fluid inflow 7 is coupled hydraulically, for example, to a high pressure fuel accumulator, such as what is known as a common rail, and is therefore supplied, for example, with a fuel at a pressure of, for example, up to 2500 bar.

The fluid outflow 9 is coupled hydraulically to a low pressure region, such as, for example, to a fuel tank.

The injection valve 1 has a needle body 10 which is arranged axially movably in the recess 3 of the injector body 2.

In a closed position of the needle body 10, the needle body 10 is seated on an associated valve seat of the injector body 2 and suppresses a fluid flow through an injection opening 12 of the injector body 2 as a result. The injection valve 1 is therefore closed.

In an open position of the needle body 10, the needle body 10 is spaced apart axially in a predefined manner from the associated valve seat and releases a fluid flow through the injection opening 12 as a result. The injection valve 1 is therefore open.

The injection valve 1 has a control space 15 which is arranged in the recess 3 and which is arranged hydraulically between the fluid inflow 7 and the fluid outflow 9. Here, the recess comprises, in particular, the space around the needle body 10, a hydraulic connecting line to the control space 15, and the control space 15 itself.

The injection valve 1 has a control valve 16 with a valve body 17. The control valve 16 is arranged in the control space 15. In a closed position of the valve body 17, the valve body 17 is seated on an associated valve seat of the injector body 2, as a result of which a fluid flow between the control space 15 and the fluid outflow 9 is suppressed.

In an open position of the valve body 17, the valve body 17 is spaced apart axially in a predefined manner from the associated valve seat and therefore releases the fluid flow between the control space 15 and the fluid outflow 9.

The injection valve 1 has a piezoelectric actuator 20 which is coupled to the control valve 16 via a first transmitter 23 for opening the control valve 16.

In addition, the piezoelectric actuator 20 can be coupled mechanically to the needle body 10, for example after a predefined idle stroke L is overcome, for example via a second transmitter 24 which is connected to the needle body 10.

Figure 7:
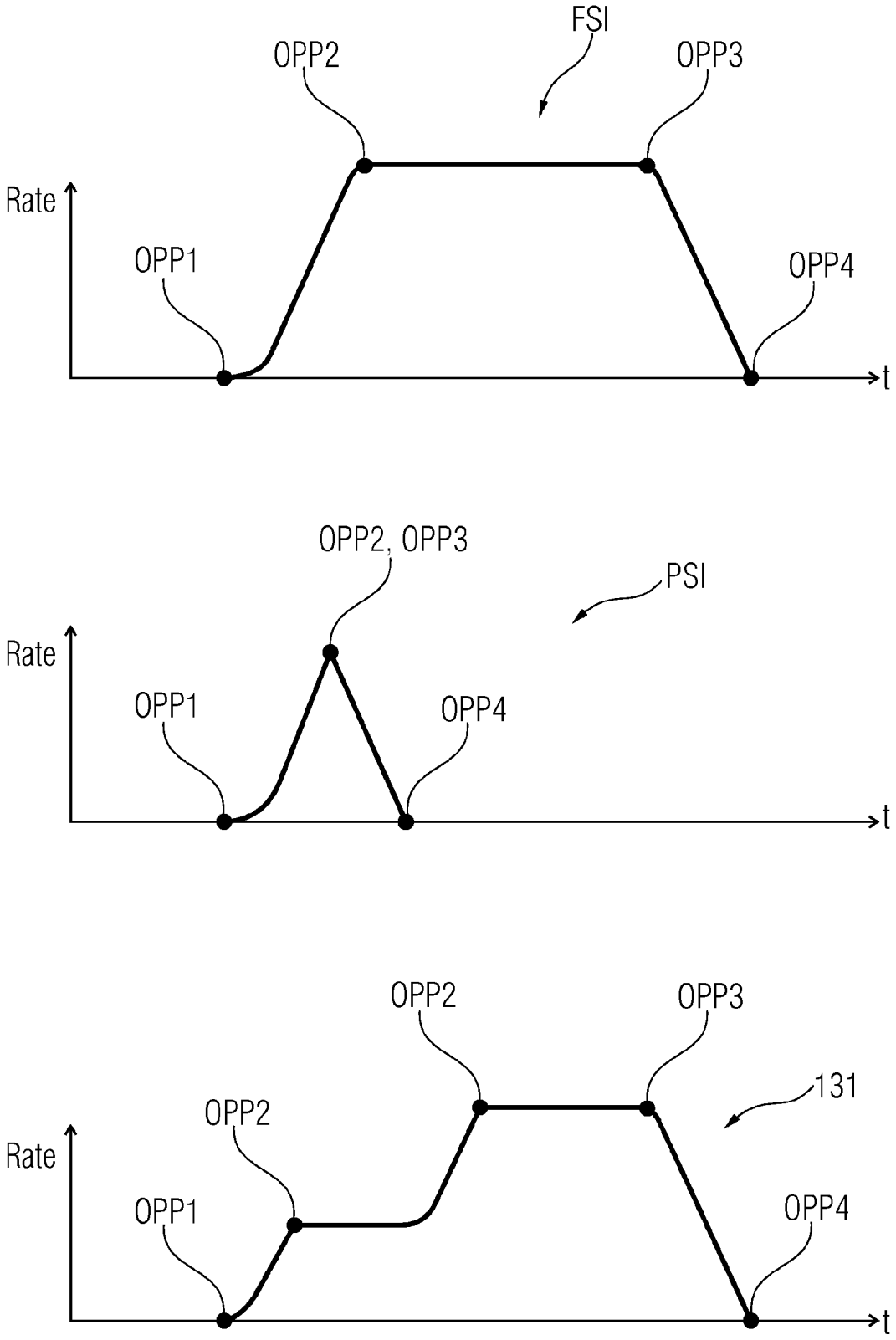
FIG. 7 shows various operating modes of the injection valve, according to teachings of the present disclosure

The injection valve 1 can be operated in various operating modes. FIG. 7 shows three operating modes. A first operating mode is what is known as a full stroke injection FSI. Here, the injection valve 1 is opened for a predefined time and is subsequently closed again. A further operating mode is what is known as a part stroke injection PSI. Here, the injection valve 1 is opened only briefly and is closed again immediately. A further operating mode is what is known as a boost injection BI. Here, the injection valve 1 is first of all opened somewhat, is opened further after a predefined time period, and is closed again after a further predefined time period. The operating modes are represented by four times: a time OPP1, at which the opening operation of the injection valve 1 begins; one or more times OPP2, at which the needle body 10 reaches the predefined opening position; a time OPP3, at which the closing operation of the injection valve 1 begins; a time OPP4, at which the needle body 10 reaches the closed position.

Figure 8:
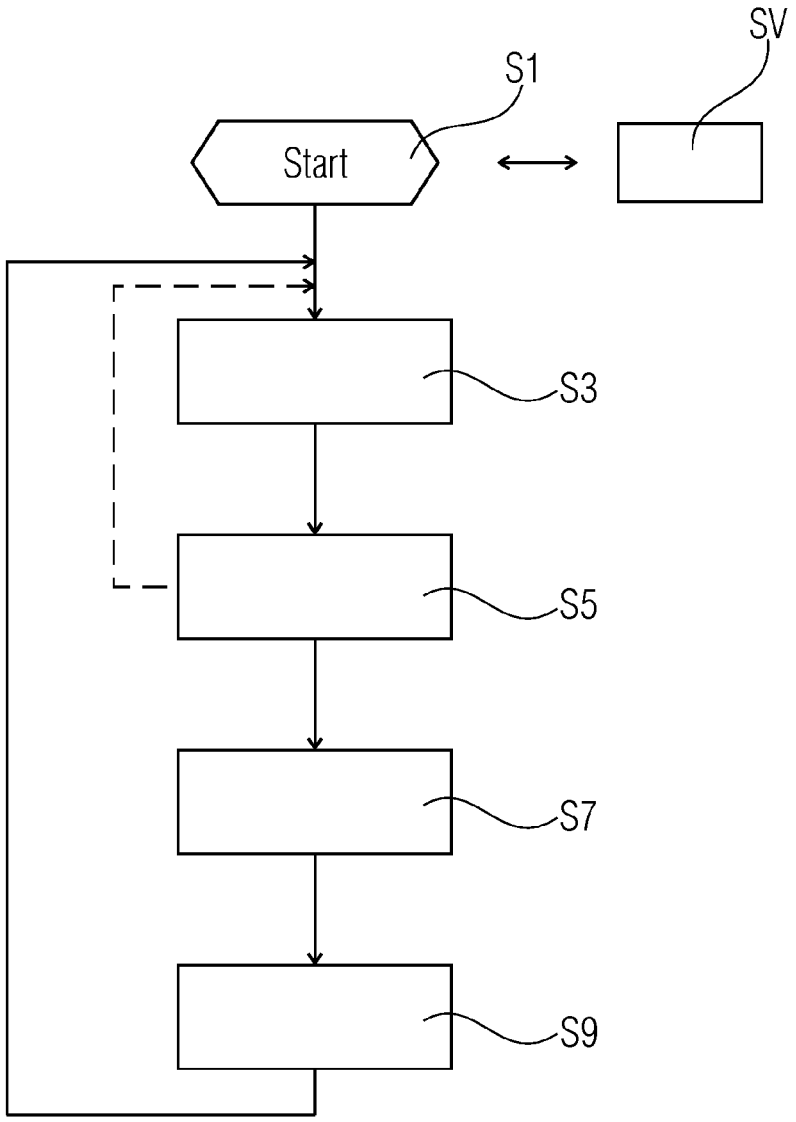
FIG. 8 shows a flow chart for the operation of the injection valve, according to teachings of the present disclosure.

FIG. 8 shows a flow chart of a program for the operation of the injection valve 1. The program can be executed, for example, by a control apparatus SV.

The program is started in a step S1. In the step S1, the piezoelectric actuator 20 is situated in a charged state (see FIG. 1). In the step S1, the recess 3 is filled with fuel under high pressure through the fluid inflow 7. The valve body 17 of the control valve 16 is situated in the closed position as a result of a balance of force which acts on the valve body 17 of the control valve 16. Furthermore, the needle body 10 is situated in the closed position as a result of a further balance of force.

In a step S3, the piezoelectric actuator 20 is discharged electrically. The start of the step S3 represents the time OPP1, at which the opening operation of the injection valve 1 begins.

The piezoelectric actuator 20 contracts as a result of the electric discharge. As a result, a force is transmitted from the piezoelectric actuator 20 via the first driver 23 to the valve body 17 of the control valve 16, with the result that the control valve 16 opens. Since a lower pressure prevails on the side of the fluid outflow 9 than in the control space 15, fluid flows from the control space 15 into the fluid outflow 9. As a result, a pressure gradient occurs in the recess 3. As a result of said pressure gradient, a force acts on the needle body 10, with the result that the latter lifts up from its associated valve seat and therefore releases the injection opening 12 (see FIG. 2, FIG. 3).

Figure 3:
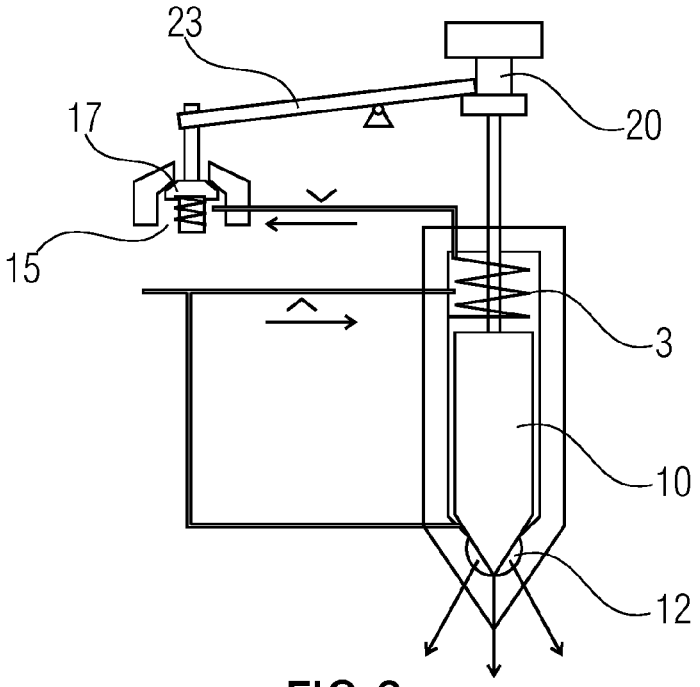

In a step S5, a time of a first mechanical bounce is detected by means of the piezoelectric actuator 20. The first mechanical bounce is produced by the fact that the second transmitter 24 overcomes the idle stroke L by way of the axial movement of the needle body 10 and comes into contact with the piezoelectric actuator 20. Here, the needle body 10 reaches the predefined open position (FIG. 3). The time of the detection of the first mechanical bounce therefore represents the time OPP2, at which the needle body 10 reaches the predefined open position.

If the injection valve 1 is operated in the full stroke injection FSI operating mode, the program is continued after a predefined time duration in a step S7.

If the injection valve 1 is operated in the part stroke injection PSI operating mode, the program is continued in the step S7 immediately after the detection of the first mechanical bounce.

If the injection valve 1 is operated in the boost injection BI operating mode, the program is continued in the step S3 after a predefined time duration and is continued in the step S7 after a further predefined time duration after the step S5 is reached again.

In the step S7, the piezoelectric actuator 20 is charged electrically in a manner which is dependent on the detected time of the first mechanical bounce, for example in a following work cycle of the injection valve 1 or in the same work cycle of the injection valve 1, in which the first mechanical bounce was detected. The start of the step represents the time OPP3, at which the closing operation of the injection valve 1 begins.

Figure 4:
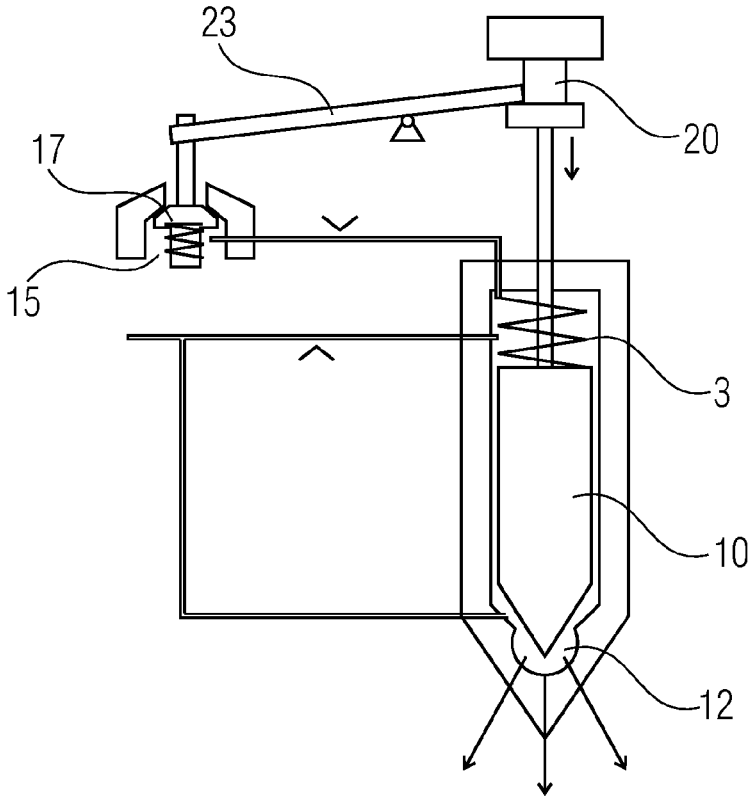
Figure 5:
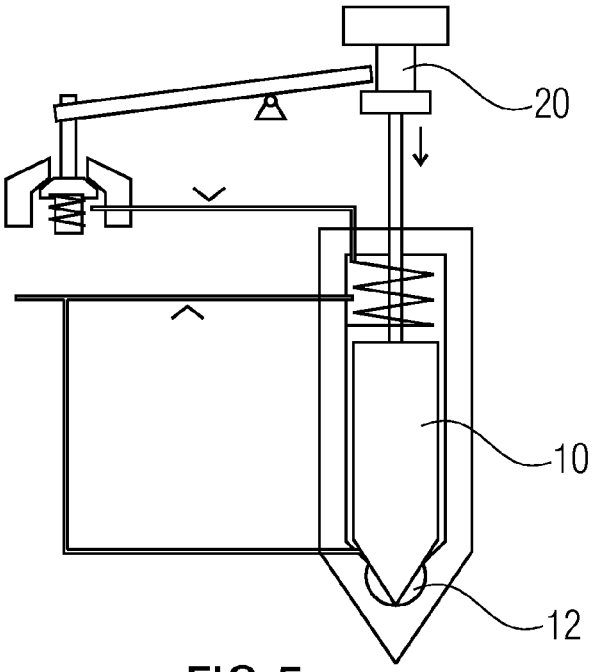

As a result of the electrical charging of the piezoelectric actuator 20, the latter extends and therefore presses the needle body 10 into its closed position by means of the mechanical coupling to the needle body 10 or to the second transmitter 24, as a result of which the fluid flow through the injection opening 12 is suppressed again (see FIG. 4, FIG. 5).

Figure 6:
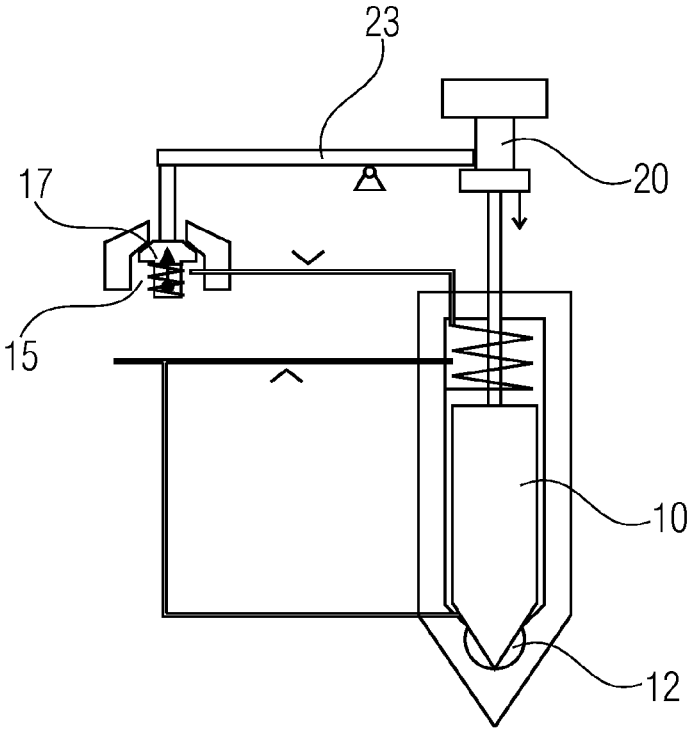

Furthermore, the balance of force which acts on the valve body 17 of the control valve 16 changes as a result of the electric charging of the piezoelectric actuator 20, with the result that said control valve 16 closes again (FIG. 6).

In a step S9, a time of a further mechanical bounce is detected by means of the piezoelectric actuator 20. The further mechanical bounce is produced as a result of the contact of the needle body 10 on the associated valve seat when the closed position of the needle body 10 is reached.

Said further mechanical bounce is transmitted to the piezoelectric actuator 20 via the needle body and the second transmitter 24. The time of the further mechanical bounce therefore represents the time OPP4, at which the needle body 10 reaches the closed position.

In a manner which is dependent on the time of the further mechanical bounce and/or the time of the first mechanical bounce, the program is continued in the step S3, possibly after a predefined time duration, and a further work cycle begins.

Since the time of the first mechanical bounce represents the time OPP2 of reaching of the predefined opening position, and since the time of the further mechanical bounce represents the time OPP4 of reaching of the closed position, the injection valve 1 can be regulated by means of said times in the full stroke injection FSI, part stroke injection PSI and boost injection BI operating modes. In this way, a very high injection accuracy can be achieved, in particular, for said operating modes.

What is claimed is:

1. An injection valve comprising:

an injector body with a recess and a fluid inflow and a fluid outflow, a needle body arranged axially movably in the recess of the injector body and suppressing a fluid flow through an injection opening of the injector body in a closed position of the needle body and otherwise releases it, a control space arranged in the recess, hydraulically between the fluid inflow and the fluid outflow, a control valve with a valve body, the control valve arranged in the control space to suppress a fluid flow between the control space and the fluid outflow in a closed position of the valve body and to otherwise release it, and a piezoelectric actuator coupled mechanically to the control valve via a first transmitter, wherein the first transmitter converts an axial movement of the actuator into a rotational movement and rotational movement of the first transmitter moves the valve body of the control valve, and the piezoelectric actuator coupled mechanically to the needle body via a second transmitter for moving the needle body, wherein the piezoelectric actuator is configured to move between (a) a first position in which the first transmitter and second transmitter are positioned to prevent fluid flow both through the control valve and through the injection opening and (b) a second position in which the first transmitter and second transmitter are positioned to allow fluid flow both through the control valve and through the injection opening, and wherein the first transmitter and the second transmitter move independently of one another.

2. The injection valve as claimed in claim 1, wherein the piezoelectric actuator becomes coupled mechanically to the needle body only after a predefined idle stroke between the second transmitter and the piezoelectric actuator has been overcome.

3. The injection valve as claimed in claim 1, further comprising the piezoelectric actuator coupled mechanically to the needle body, when the closed position of the needle body is reached and when a predefined open position of the needle body is reached.

* * * * *